US005367838A

United States Patent [19]

Visaisouk et al.

[11] Patent Number: 5,367,838

[45] Date of Patent: Nov. 29, 1994

[54] PARTICLE BLASTING USING CRYSTALLINE ICE

[75] Inventors: Somyong Visaisouk, Sidney; Somnuk Vixaysouk, Victoria, both of Canada

[73] Assignee: Ice Blast International, Inc., Macomb County, Mich.

[21] Appl. No.: 210,724

[22] Filed: Mar. 21, 1994

Related U.S. Application Data

[63] Continuation of Ser. No. 115,672, Sep. 2, 1993, abandoned, which is a continuation of Ser. No. 891,051, Jun. 1, 1992, abandoned.

[51] Int. Cl.[5] ..... B24C 1/00

[52] U.S. Cl. ..... 451/39; 451/75; 134/7

[58] Field of Search ..... 51/317, 319, 320, 321, 51/322, 427, 428, 429, 436, 438, 410; 134/5, 7

[56] References Cited

U.S. PATENT DOCUMENTS

| | | | |
|---|---|---|---|
| 3,676,963 | 7/1972 | Rice et al. | 51/320 |
| 4,038,786 | 8/1977 | Fong | 51/320 |
| 4,389,820 | 6/1983 | Fong et al. | 51/320 |
| 4,617,064 | 10/1986 | Moore | 51/320 |
| 4,655,847 | 4/1987 | Ichinoseki et al. | 51/320 |
| 4,703,590 | 11/1987 | Westergaard | 51/320 |
| 4,744,181 | 5/1988 | Moore et al. | 51/320 |
| 4,924,643 | 5/1990 | Buiguez et al. | 51/436 |
| 4,965,968 | 10/1990 | Kelsall | 51/410 |
| 5,009,240 | 4/1991 | Levi | 51/320 |
| 5,025,597 | 6/1991 | Tada et al. | 51/322 |
| 5,063,015 | 11/1991 | Lloyd et al. | 51/320 |
| 5,203,794 | 4/1993 | Stratford et al. | 51/322 |

FOREIGN PATENT DOCUMENTS

| | | |
|---|---|---|
| 0268449 | 5/1988 | European Pat. Off. . |
| 2475425 | 2/1980 | France . |
| 2494160 | 11/1980 | France . |
| 029277 | 2/1985 | Japan . |
| 236472 | 10/1986 | Japan . |
| 120978 | 6/1987 | Japan . |
| 140767 | 6/1987 | Japan . |
| 1397102 | 6/1975 | United Kingdom . |
| 1171624 | 9/1986 | United Kingdom . |
| 2171624 | 9/1986 | United Kingdom . |
| WO90/14927 | 12/1990 | WIPO . |
| WO91/04449 | 4/1991 | WIPO . |

*Primary Examiner*—Jack W. Lavinder
*Attorney, Agent, or Firm*—Brooks & Kushman

[57] ABSTRACT

The invention relates to an improved method and apparatus for particle blasting utilizing crystalline ice. A theory of impact erosion is presented, as opposed to conventional abrasive techniques, which allows for the development of ice blast conditions to achieve a maximum efficiency for surface cleaning and coating removal applications. By impacting a surface with ice particles which have been treated to bring their temperature near the melting point of ice, erosion is effected by a rupture process caused by the well known reaction-force. It has been found that warming of the ice particles can be realized by simply utilizing unconditioned blast air taken directly form a high pressure compressor.

3 Claims, 3 Drawing Sheets

PARTICLE BLASTING USING CRYSTALLINE ICE

This is a continuation of pending prior application Ser. No. 08/115,672 now abandoned which was filed on Sep. 2, 1993 as a continuation of prior application Ser. No. 07/891,051 which was filed on Jun. 1, 1992 and is now abandoned.

BACKGROUND OF THE INVENTION

The invention relates to particle blast technology and, more particularly, to a method and apparatus for particle blasting utilizing crystalline ice particles.

Particle blast technology is well known and well used in industrial processes as a means for cleansing surfaces. Blast particle media include sand, grit, steel shots, nut shells, glass, plastic, corn starch, etc. These materials generally effect cleaning and surface preparation through an abrasive process wherein particles are projected by an air stream at a target surface resulting in surface erosion. However, abrasive processes are not practical or useful in certain applications as the degree of surface erosion effected is difficult to control and the occurrence of unintentional damage to the target surface may result. Also, a large amount of dust is is typically generated producing a hazardous and unfriendly working environment, both for the humans and for machinery.

In view of the above-mentioned deficiencies, alternative solid particle media have been proposed. In one variation of the technology, dry-ice (solid carbon dioxide) is pelletized into particles and used as the blast medium. On impact sublimation occurs and no dust is generated. Furthermore, such pellets are are relatively soft and, thus, do not tend to damage the surface to be cleaned under normal operating conditions. One drawback of this approach is that sublimation of dry ice results in the formation of a smoke-like vapor so that the object to be cleaned cannot be seen and consequently the cleaning procedure is adversely affected. Another consideration would be the relatively high cost representative of this particular blast medium.

A further variation provides the use of crystalline ice particles for effecting surface cleaning. Descriptions of various methods and apparatuses employing ice particles as the blast medium can be found in PCT patent application CA90/00174 entitled "Particle Blast Cleaning and Treating of Surfaces", publication number WO 90/14927 and publication date Dec. 13, 1990; PCT patent application CA90/00291 entitled "Apparatus for Preparing, Classifying and Metering Particle Media", publication number WO 91/04449 and publication date Apr. 4, 1991; and British patent application 2,171,624A published Sep. 3, 1986. Crystalline ice particles are considered an inexpensive and fairly non-abrasive blast medium which lends itself to dust-free surface cleaning and coating removal, and facilitates cleanup and waste management. However, the cleaning efficiency of an ice blasting method is low relative to the abrasive techniques previously mentioned. It is generally believed that production of ice particles with sharp edges and utilizing low temperatures to enhance the hardness and strength of the particles are factors that contribute to improved abrasiveness and therefore effectiveness of this blast medium. Enhancement of ice particle hardness is achieved in conventional devices by incorporating an air cooling unit in order to cool the blast air projecting the particles. Overheads associated with this air cooling unit provide additional cost, weight and size to the blasting apparatus, along with increasing the overall power consumption of the device.

SUMMARY OF THE INVENTION

It is an object of the invention to provide an improved method and apparatus for particle blasting utilizing crystalline ice particles.

It is another object of the invention to increase the effectiveness of low temperature particles, in particular ice particles as a blast medium.

It is yet another object of the invention to provide an apparatus employing crystalline ice particles as the blast medium with reduced cost and more power efficiency than conventional devices.

Therefore, in accordance with one aspect of the invention, there is provided a blasting process for cleaning or decoating a surface comprising, propelling frozen or sublimable particles at the surface, the particles having a temperature near the melting point or sublimation point of the particles.

According to another aspect of the invention, there is provided a blasting process for cleaning or decoating a surface comprising, propelling frozen or sublimable particles at the surface by warm blasting air.

According to a further aspect of the invention, there is provided a blasting apparatus for cleaning or decoating a surface comprising: ice supply means for supplying ice particles; fluidizing means for providing a fluidized flow of the ice particles entrained in cold dry air; conveying means for transporting the fluidized flow to a blast nozzle; and warm blast air means connected to the blast nozzle for propelling the ice particles of the fluidized flow at the surface.

The inventors of the present invention have done extensive research in the area of blast technology in order to better understand the phenomenon of ice particle induced erosion. It has been discovered that under certain blast conditions, much more erosion of the target surface can be achieved than that expected from the hardness or abrasiveness of the ice particles. Under these conditions, very tough coatings such as marine enamel or polyurethane can be readily removed by ice blasting. The inventors have realized a theory of impact erosion by relatively non-abrasive particles with the underlying principle being Sir Isaac Newton's third law of motion, namely to every action there is always opposed an equal reaction. This theory allows for the development of ice blast conditions to achieve a maximum efficiency for coating removal applications and for the practical implementation of ice blast processes.

A relatively non-abrasive impacting particle, regardless of being sharp or blunt, when approaching the target material at a sufficiently high speed such as that in typical blast conditions, will cause maximum target material erosion when the approach is normal to the target surface. Target erosion does not proceed by abrasion of the impacting particles, but rather by a rupture process caused by the well-known action-reaction force. The impacting particles merely act as a means of transferring an impacting force to the target material. On impact, the particle melts or disintegrates. The impacted zone of the target material subsequently exerts an opposite reaction force away from the surface. In this way, impacting particles generate successive compression and tensile stresses on the target material to eventually cause rupture or ejection of surface material.

Contrary to intuition and logical deduction, it has been found that improved performance in blasting is attained by utilizing high temperature air, preferably taken directly from an air compressor without further treatment as to drying and cooling, to propel ice particles at a surface. For operator comfort, a standard aftercooler may be employed. It has been further found that suitably selected ice particle size and blast air pressure, and the manner which ice particles approach the target surface, can combine to produce specific end results for surface cleaning purposes or for coating removal purposes.

BRIEF DESCRIPTION OF THE DRAWINGS

In order that the invention may be more clearly understood, an embodiment will be described with reference being made to the figures shown in the accompanying drawings, in which.

DETAILED DESCRIPTION OF THE INVENTION

The phenomenon of impact erosion will now be discussed with reference to FIGS. 1A–1D. Conventional thinking is that abrasion is the dominant mechanism behind surface erosion, but with small ice particles at high speed abrasion is not in fact the cause of erosion at all. In actuality, erosion is effected by a rupture process whereby tensile stress acting on a surface overcomes the cohesive forces of the target material resulting in rupture. Coating removal results when tensile stress acting on a surface coating overcomes adhesive forces between the coating and the substrate. The tensile stress is a reaction force generated by the application of an impact force on the target surface.

Figure 1A:
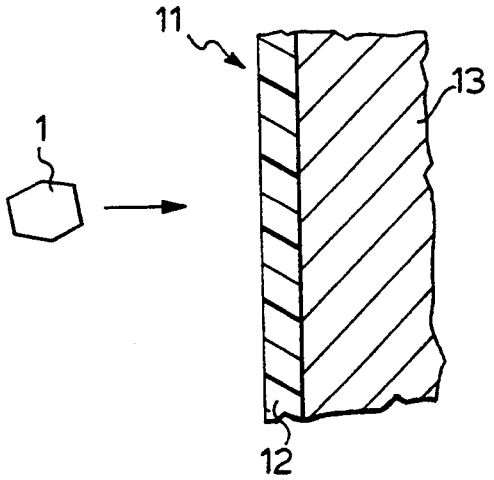
FIGS. 1A–1D illustrate progressively the impact erosion theory in accordance with the ice blasting process of the invention.

FIG. 1A shows an ice particle 10 traveling towards a target surface 11 comprising a surface coating 12 and substrate 13. It is preferable that the ice particle 10 travel and thus impact the target surface 11 at a normal incidence as a normal approach by particles causes the most efficient transfer of impact force to the surface coating 12 and substrate 13. However particles impacting the target surface 11 at any approach angle will generate an impact force, but to a lesser degree than a normal approach.

Figure 1B:
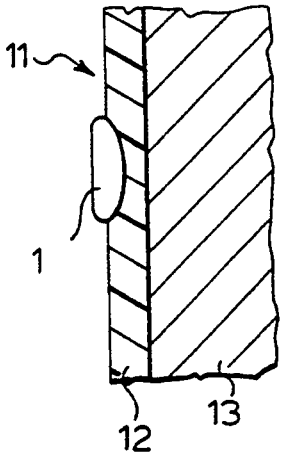

FIG. 1B depicts the ice particle 10 impacting with the target surface 11. Upon impact, the ice particle 10 deforms while applying compressive stress to the surface coating 12. This impacting action results in the transfer of force from the ice particle 10 to the surface coating 12 and substrate 13. The target material is therefore under compressive stress.

Figure 1C:
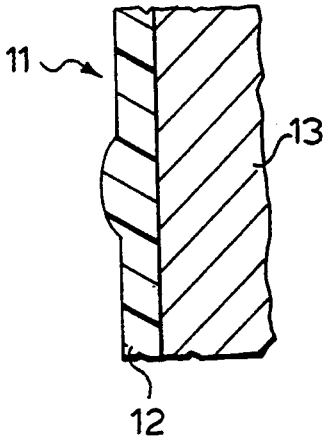

As shown in FIG. 1C, the surface coating 12 reacts to the impacting force applied. The surface coating 12 is now under tensile stress from reaction forces generated by the surface coating 12 along with the substrate 13 responsive to the compression force generated by an impacting particle. If the impacting particle is still present and in contact with the target surface 11 subsequent to initial impact, it is apparent that the tensile stress generated would be applied to both the particle and surface coating 12, and may not be sufficient to overcome the adhesive bond between the surface coating 12 and the substrate 13. Thus, there is desirability to have the impacting force source removed immediately after application so the reactive tensile stress will act solely on the surface coating 12 to effect disbonding. This desirability can be achieved when using crystalline ice as the source to apply the impacting force by providing a condition which facilitates rapid melting or disintegration of the particles immediately after impact with the target surface 11. This condition can be effected by using high temperature blast air to project the particles.

Figure 1D:
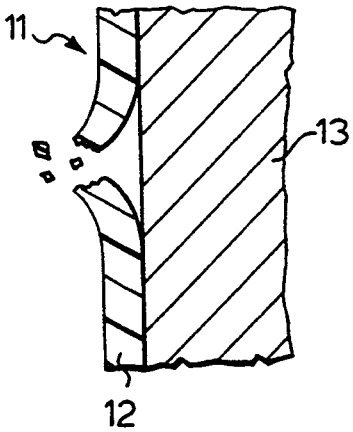

FIG. 1D illustrates the reaction of the surface coating 12 to the tensile force applied to it. When a tensile force of sufficient magnitude is generated, overcoming the adhesive bond between the surface coating 12 and substrate 13, the result is the rupturing of the surface coating 12 in the general area where the particle first impacts the target surface 11. Once an initial surface rupture occurs, the overall integrity of the surface coating 12 in the vicinity of the rupture is adversely affected which enhances removal of the surrounding surface coating 12 from the substrate 13.

Further considerations for maximizing the reaction force generated would be the density and rate at which the ice particles impact the target surface along with the physical size of the ice particles used. It has been found that as the impact density of particles increases, the performance of the ice blasting process deteriorates. Also, use of smaller particles helps to maximize impact stress on loading and also to maximize tensile stress through rapid disintegration after impact, thereby improving results.

Figure 2:
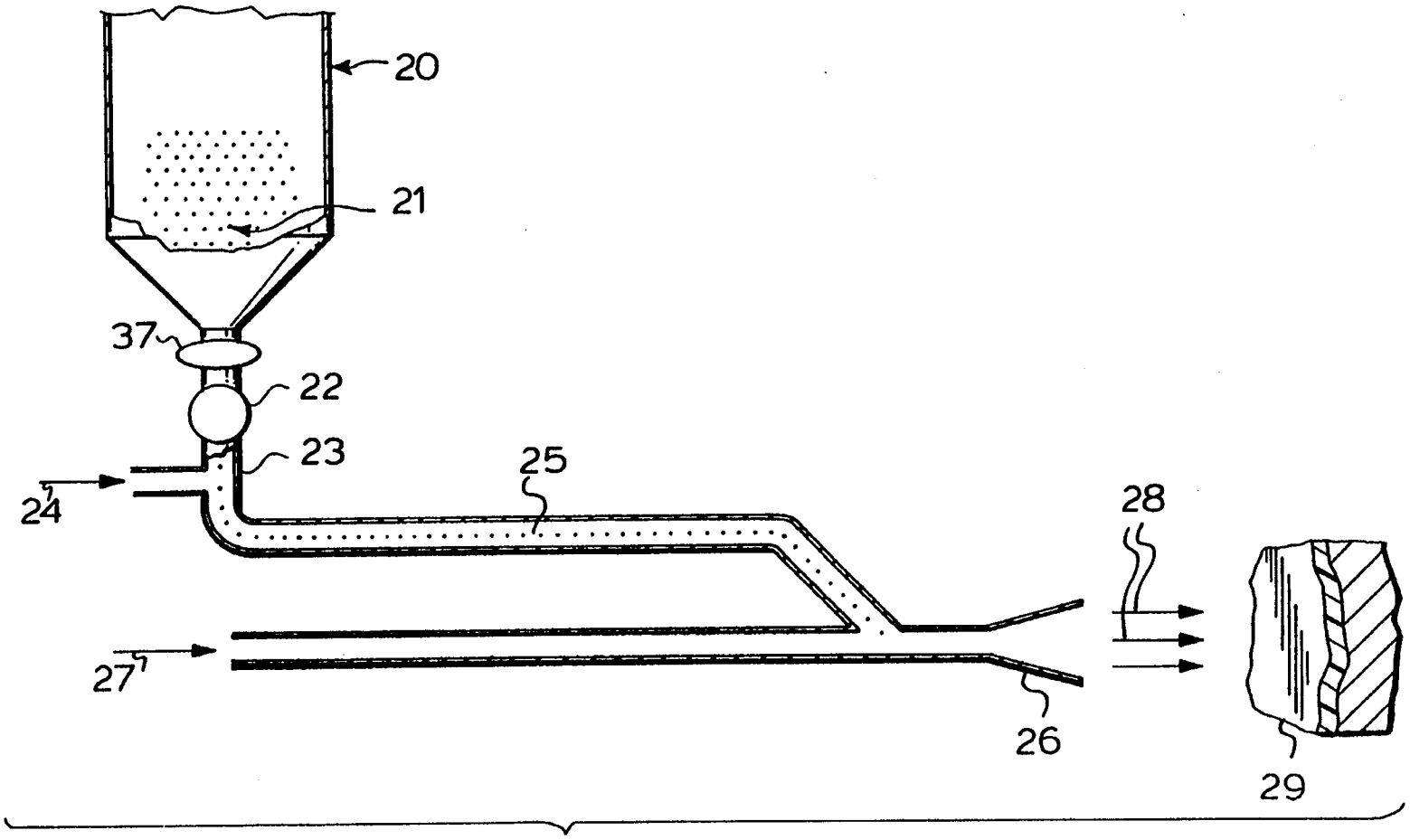
FIG. 2 illustrates diagrammatically an embodiment of an ice blasting apparatus in accordance with the invention.

Turning now to FIG. 2, a general illustration is presented of a blasting apparatus utilizing crystalline ice particles as the blast medium. The ice blasting apparatus includes a storage unit 20 containing ice particles 21 which are continuously agitated to prevent cohesion thereof. The ice particles 21 are fed by gravity through a metering device or flow controller 22 into a transport hose 23. The flow controller 22 permits adjustment of the rate at which ice particles enter the transportation hose 23 and, therefore, act as a means for controlling the quantity of particles projected and impacting the target surface 29. A sizer device 37 may be inserted after the flow controller 22 to limit the size of the ice particles permitted to enter the transportation hose 24. Smaller particles, typically of a maximum of two millimeters in each direction, have been found to be most efficient at effecting impact erosion because they generally tend to melt once contacting the surface.

The particle stream entering the transportation hose 23 is combined with low pressure compressed air 24 and this fluidized particle stream 25 flows along the transport hose 23 to the blast nozzle 26. Since the low pressure compressed air 24 is the vehicle by which movement of the ice particles through the transportation hose 23 towards the blast nozzle 26 is effected, it is necessary for this compressed air 24 to be sufficiently cool and dry in order to minimize attrition of the fluidized particles 25 as the length of the transport hose 23 may be considerable, for example, in excess of two hundred and fifty feet. Transport air temperature should be in the range of −5° F. to 15° F., depending on the ambient temperature.

At the blast nozzle 26, the fluidized particle stream 25 is entrained by a stream of high pressure compressed air 27 producing a blast stream 28 to be directed at a target surface 29 for cleaning. Typically, the ratio of fluidizing to blast air volumes is within the range of 0.005:1 to 0.25:1, with the ratio 0.15:1 normally used. The high pressure compressed air 27 should be of a suitably warm temperature at least ambient, preferably in the range of 70° F. to 130° F., to facilitate rapid disintegration of the particles upon impact with the target surface 29. It has been found that superior performance of the blasting apparatus was achieved by utilizing high temperature air taken directly from an air compressor, without any further treatment as to drying and special cooling, as required by conventional systems. For example, the blast air 27 produced by a high pressure air compressor may have a temperature in the order of 150° F. Once this blast air 27 is mixed at the blast nozzle 26 with the fluidized ice particles 25, a blast stream 28 is expelled from the nozzle 26 having a temperature of approximately 60° F. Such a design provides a blasting apparatus construction which is cheaper and simpler than conventional devices. With certain constructions, a standard aftercooler may be used to slightly reduce the temperature of the air from the compressor for safety and operator comfort. Although for other instances, the blast air may be cooled by the environment within which the apparatus operates and, in fact, can reach ambient temperature by the time the air arrives at the blasting head.

Since the volume of warm blast air 27 is larger than that of cooled blast air, hot air taken directly from a compressor also represents a major cost benefit. That is to say, this increased volume of air means there is more air available for propelling the ice particles from the nozzle 26 to achieve a greater speed than in cool air blasting devices. Observed results indicate that speed increases of up to 20% can been obtained. This is particularly relevant as faster moving particles apply a greater force on impacting the target surface generating a larger reaction force, as well as facilitating particle melting or disintegration.

Other aspects of the ice blasting apparatus of the present invention that affect its performance at cleaning and decoating surfaces are the amount of blast air pressure used, which is dependent upon the application, and the manner in which the blast stream applied. For applications such as cleaning, degreasing and surface decontamination, compressed air of up to 130 psig is preferred. Applications involving decoating of enamel materials, rubber seal removal or dechroming typically require blast air pressure in the range between 130 and 170 psig, and decoating of polyurethane materials requires air pressure from 170 to 250 psig. Furthermore, for decoating applications, the most effective and efficient results are obtained when the blast stream is directed essentially perpendicular, i.e. at 90 degrees, to the target surface.

Figure 3:
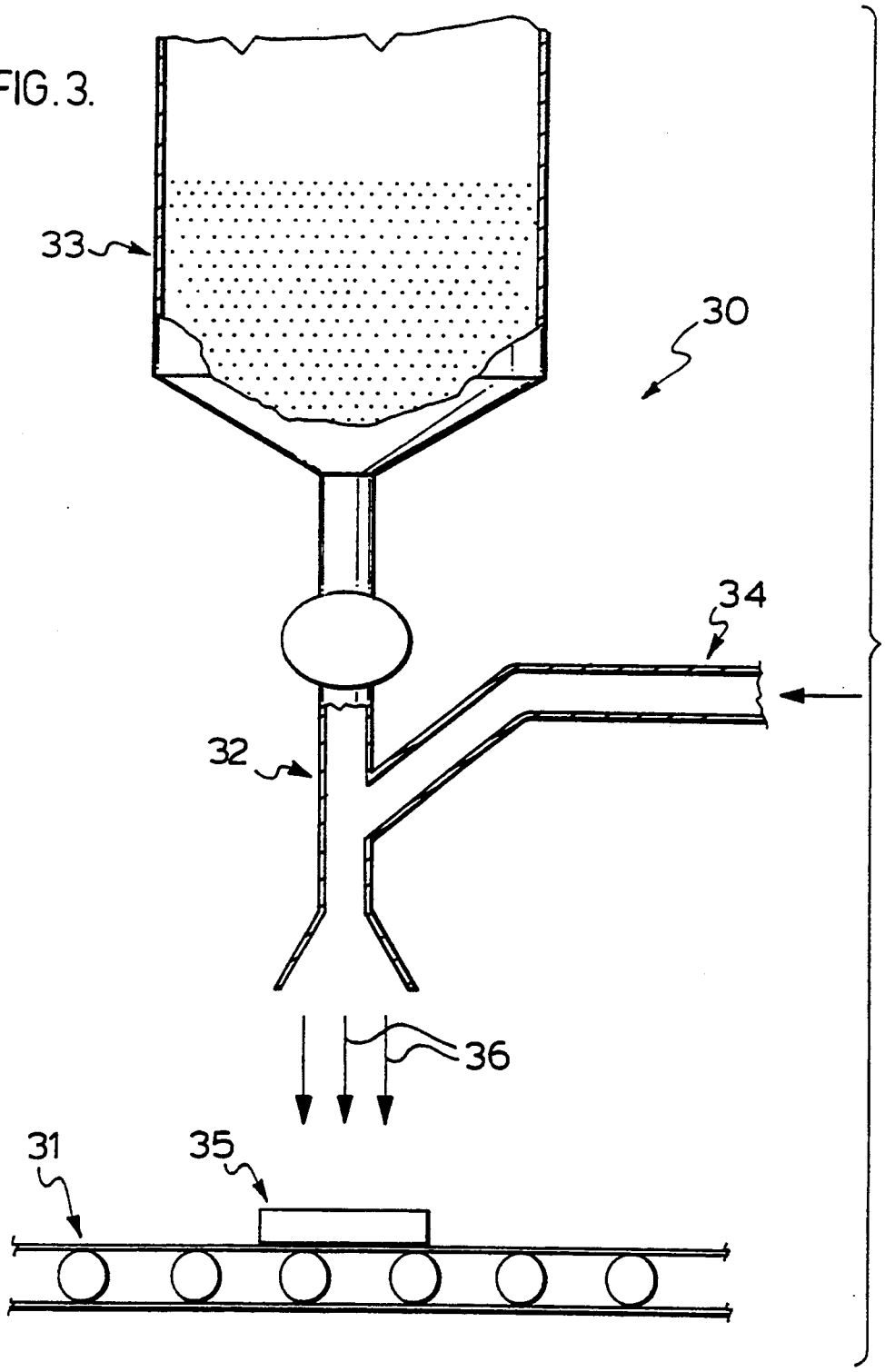
FIG. 3 illustrates diagrammatically an alternate embodiment of an ice blasting apparatus in accordance with the invention.

An alternate embodiment of an ice blasting apparatus is illustrated in FIG. 3. In typical industrial applications, the supply of crystalline ice particles can be so arranged to effectively use gravity as a means of transporting the particles to the blast nozzle, therefore eliminating the need of cold dry low pressure compressed air for fluidizing the ice particles. Depicted is a blasting apparatus 30 positioned above a conveyor belt 31 on which the article 35 to be cleaned is transported and positioned directly beneath the nozzle 32 of the blasting apparatus 30. The storage unit 33 containing the ice particles is connected directly to the blast nozzle 32. This unit 33 is arranged in such a manner relative to the blast nozzle 32 that gravity acts to feed the ice particles to the blast nozzle 32. A compressor providing high pressure warm air is connected to the blast nozzle 32 via an air hose 34. At the nozzle the ice particles are combined with the high pressure air producing a blast stream 36 which is directed at the article 35.

Further alternate embodiments could employ as the blast medium dry-ice or any other particles which tend to melt or sublimate upon impacting a surface. The process provides a condition which facilitates the melting or sublimation of the blast medium, thereby achieving a similar effect to that of the ice particle embodiments previously described.

The foregoing description has been limited to specific embodiments of the invention. It will be apparent, however, that variations and modifications may be made to the invention, with the attainment of some or all of the advantages of the invention. Therefore, it is the object of the appended claims to cover all such variations and modifications as come within the true spirit and scope of the invention.

The invention claimed is:

1. A blasting process for cleaning or decoating a surface comprising:

fluidizing frozen ice particles with compressed fluidizing air;

transporting the fluidized ice particles to a blast nozzle; and propelling the fluidized ice particles from the blast nozzle toward the surface by compressed blasting air that is sufficiently warm such that the blasted ice particles have a temperature sufficiently near the melting point so as to melt immediately upon impacting the surface.

2. A blasting process as in claim 1 wherein the ice particles are propelled toward the surface in a perpendicularly directed relationship.

3. A blasting process as in claim 1 wherein the fluidized ice particles are passed through a sizer prior to being propelled at the blast nozzle so as to have maximum dimensions that are no larger than 2 mm.

* * * * *